US008254593B2

(12) United States Patent
Peng

(10) Patent No.: US 8,254,593 B2
(45) Date of Patent: Aug. 28, 2012

(54) EARPHONE

(75) Inventor: Shuang Peng, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 247 days.

(21) Appl. No.: 12/788,316

(22) Filed: May 27, 2010

(65) Prior Publication Data

US 2011/0280412 A1 Nov. 17, 2011

(30) Foreign Application Priority Data

May 17, 2010 (CN) ..... 2010 1 0174592

(51) Int. Cl.
*H04R 1/10* (2006.01)

(52) U.S. Cl. ..... 381/74

(58) Field of Classification Search ..... 381/74, 381/309, 310, 327
See application file for complete search history.

(56) References Cited

U.S. PATENT DOCUMENTS 3,602,650 A * 8/1971 Ban ..... 360/73.06
3,862,379 A * 1/1975 Pless ..... 381/74
3,906,160 A * 9/1975 Nakamura et al. ..... 381/340
5,420,739 A * 5/1995 Yokozawa et al. ..... 360/137

* cited by examiner

*Primary Examiner* — Ping Lee
(74) *Attorney, Agent, or Firm* — Altis Law Group, Inc.

(57) ABSTRACT

An earphone includes an audio input terminal, an audio output terminal, a spring, and a rheostat. The rheostat includes a first terminal, a second terminal, and a slide terminal. The audio input terminal is electrically connected to the slide terminal of the rheostat. The audio output terminal is electrically connected to the first terminal of the rheostat. The slide terminal of the rheostat is fixed to the spring. The slide terminal of the rheostat is at or near the first terminal of the rheostat in response to the spring being at an original position. The slide terminal moves to the second terminal of the rheostat in response to the spring being pressed to deform.

6 Claims, 6 Drawing Sheets

EARPHONE

BACKGROUND

1. Technical Field

The present disclosure relates to an earphone.

2. Description of Related Art

When using an earphone to listen to music or other audio files, users may put the earphone on theirs heads first, and then play an associated audio file. Sometimes, the initial volume of the audio file will be very high, which may hurt the users.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawing in which like references indicate similar elements, is illustrated by way of example and not by way of limitation. It should be noted that references to "an" or "one" embodiment in this disclosure are not necessarily to the same embodiment, and such references mean at least one.

Figure 1:
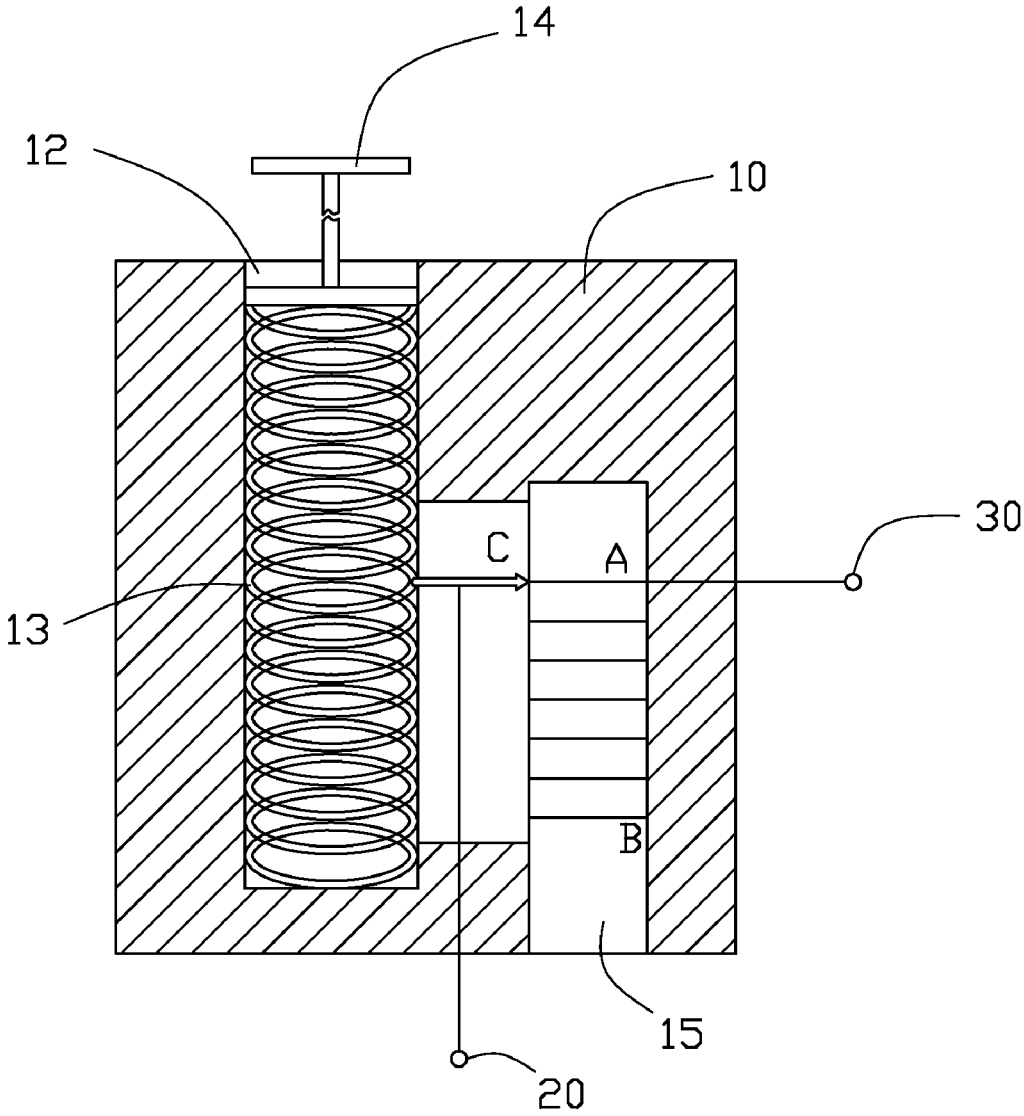
FIG. 1 is a partial, cross-sectional view of a first embodiment of an earphone, in a first state.
Figure 2:
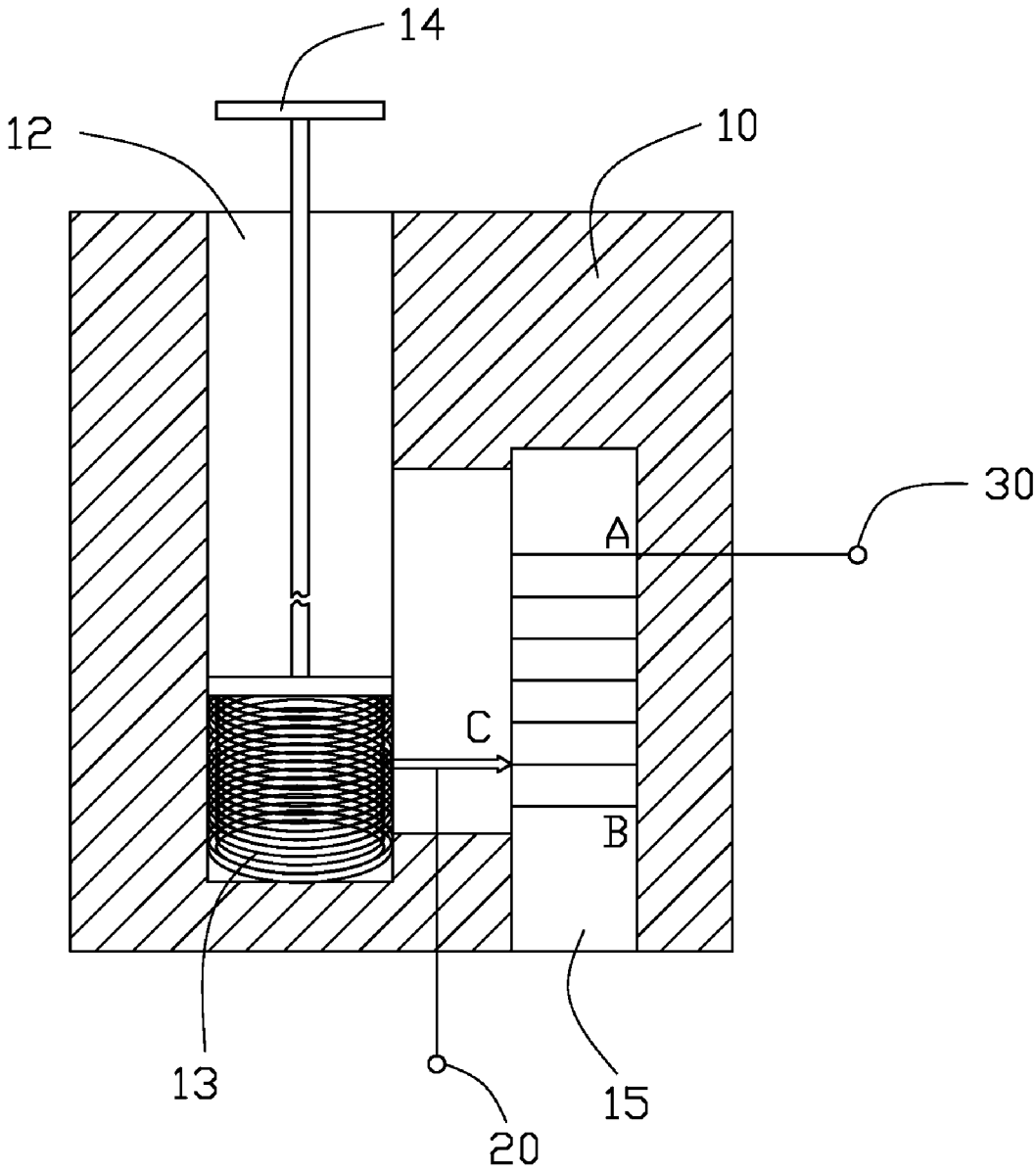
FIG. 2 is similar to FIG. 1, but shows the earphone in a second state.
Figure 3:
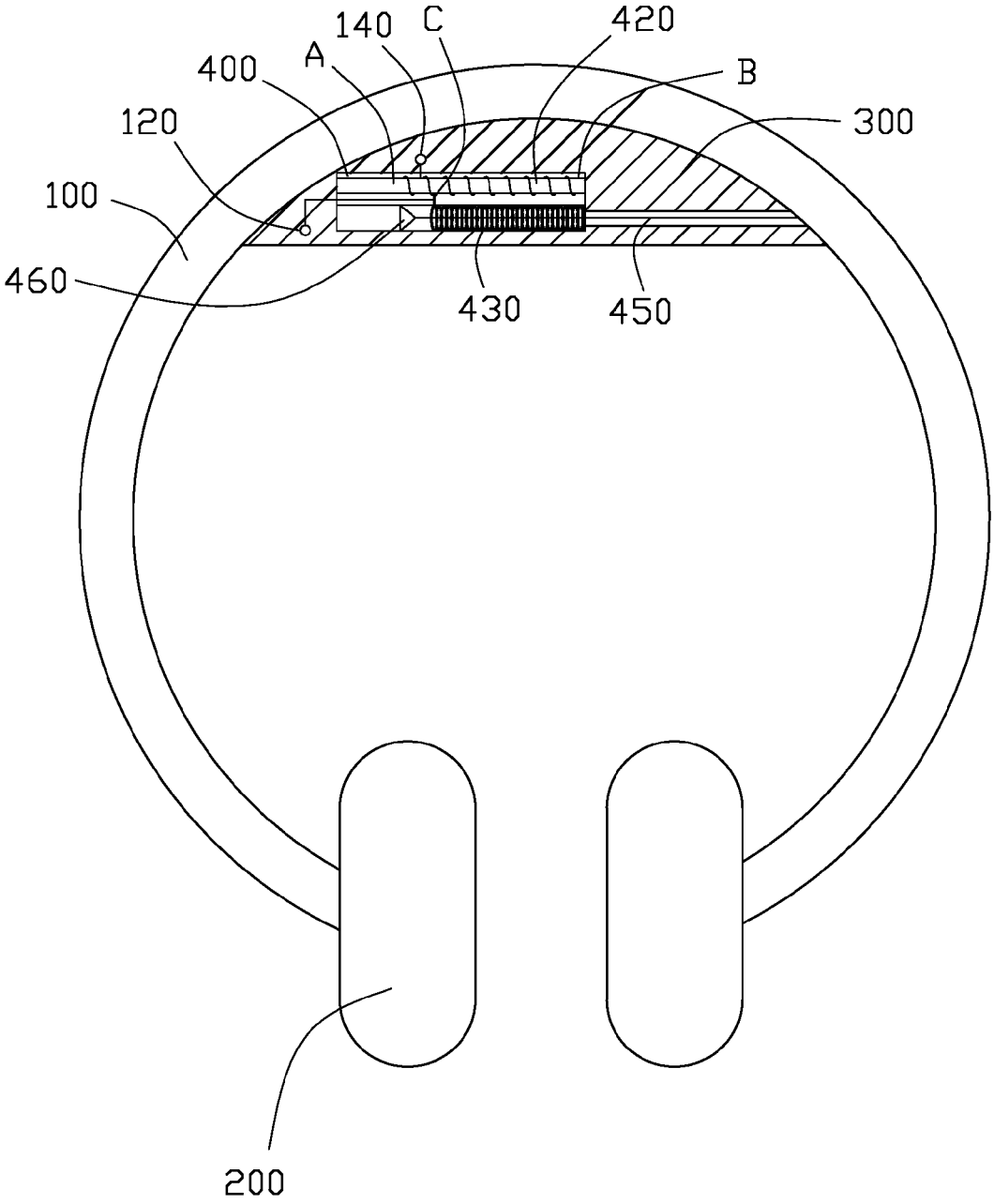
FIG. 3 is a cross-sectional view of a second embodiment of an earphone, in a first state.
Figure 4:
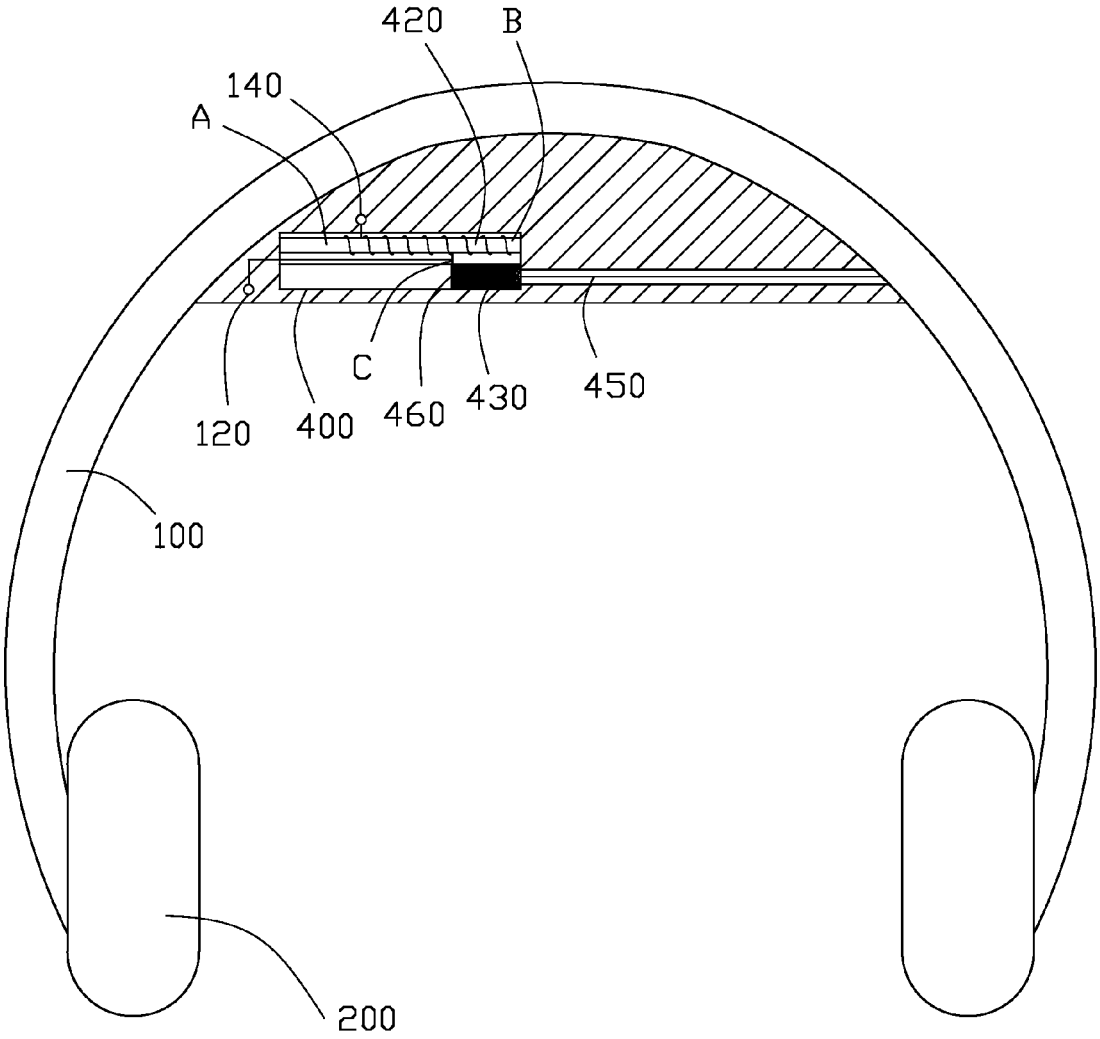
FIG. 4 is similar to FIG. 3, but shows the earphone in a second state.
Figure 5:
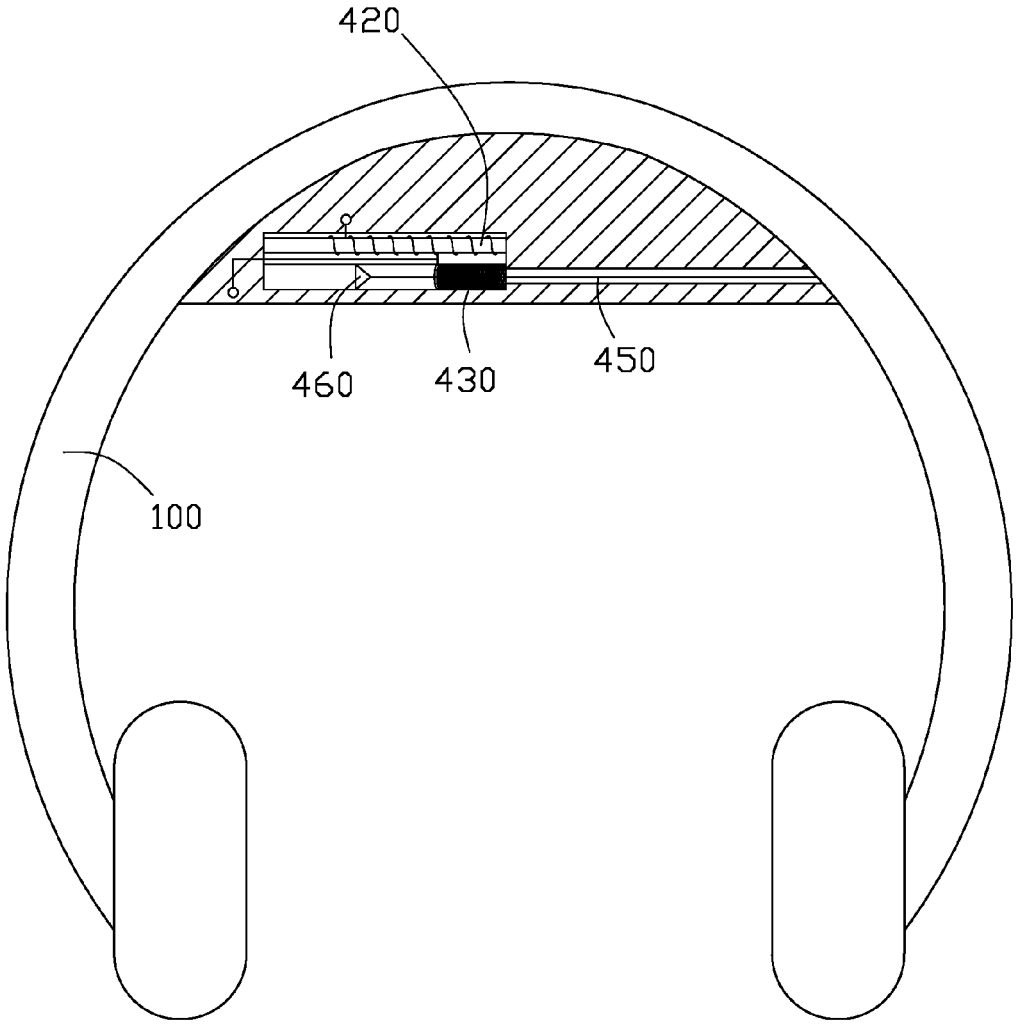
FIG. 5 is similar to FIG. 3, but shows the earphone in a third state.
Figure 6:
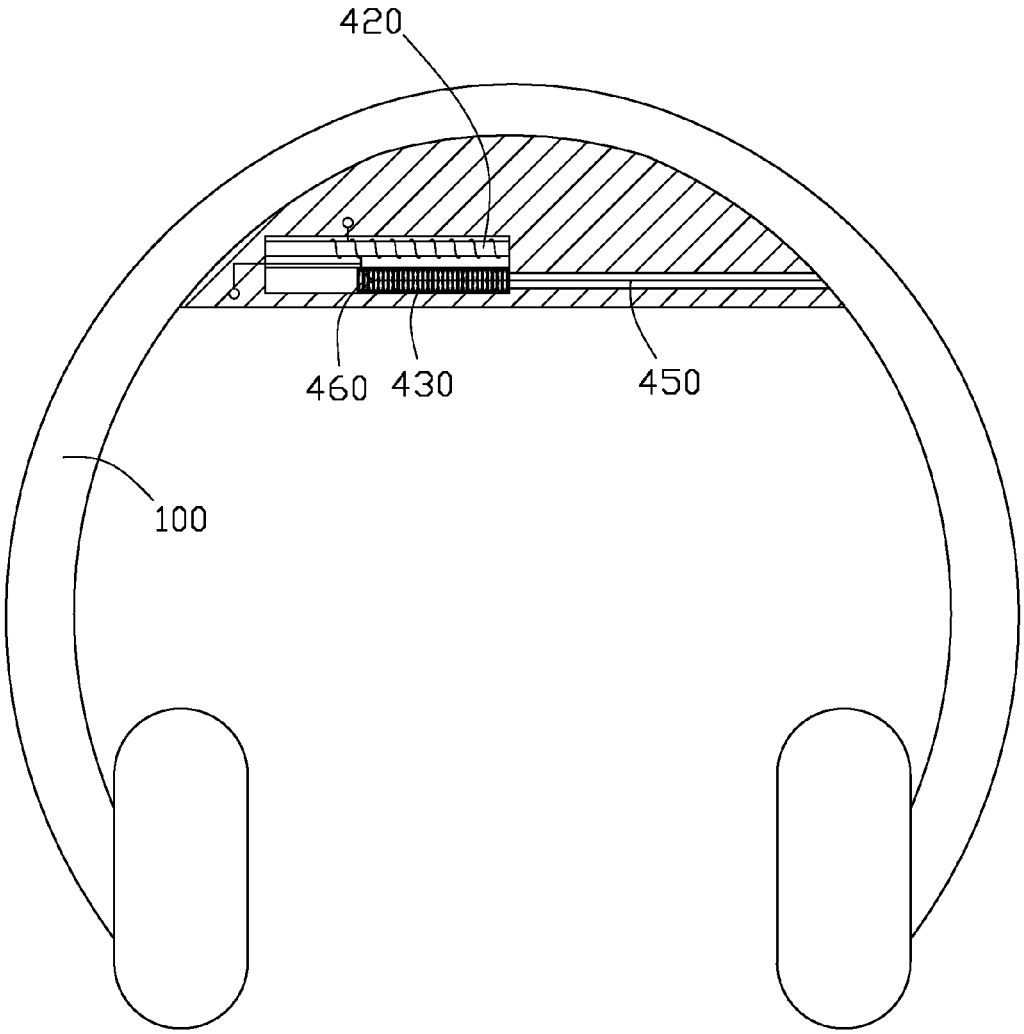
FIG. 6 is similar to FIG. 3, but shows the earphone in a fourth state.

Referring to FIGS. 1 and 2, a first embodiment of an earphone includes a main body 10, an audio input terminal 20, and an audio output terminal 30. It may be understood that the earphone also includes other elements, such as an audio plug connected to the audio input terminal 20 and two earplugs connected to the audio output terminal 30, for example. These other elements fall within well-known technologies, and are therefore not described here. The main body 10 is designed at an appropriate position of the earphone according to requirements.

The main body 10 defines a cylindrical spring container 12 to contain a spring 13. A first terminal of the spring 13 contacts a bottom of the container 12. A second terminal of the spring 13 is connected to a button 14 exposed outside of the container 12. The spring 13 can be deformed to shorten (see FIG. 2) when the button 14 is pressed. After releasing the button 14, the spring 13 restores to its original position (see FIG. 1).

The earphone includes a rheostat 15 embedded in the main body 10 parallel to the spring 13. A first terminal A of the rheostat 15 is electrically connected to the audio output terminal 30. A slide terminal C of the rheostat 15 is electrically connected to the audio input terminal 20. The slide terminal C of the rheostat 15 is also fixed to the spring 13. When the spring 13 is at the original position, the slide terminal C of the rheostat 15 is at or near the first terminal A. When the spring 13 is pressed, the slide terminal C moves to a second terminal B of the rheostat 15 opposite to the first terminal A. In other words, when the button 14 is not pressed, a resistance between the audio input terminal 20 and the audio output terminal 30 is the least. When the button 14 is pressed, the resistance between the audio input terminal 20 and the audio output terminal 30 is increased.

In use, a user grasps the earphone and presses the button 14 to play an associated audio file when the user puts the earphone on his or her head. Because the button 14 is pressed firstly, the resistance between the audio input terminal 20 and the audio output terminal 30 is increased by the rheostat 15, the volume of the earphone is reduced. After the earphone is placed on the head and the button 14 is released, the spring 13 restores to its original position. The restoration of the spring 13 can be relatively gradual according to the choice of a coefficient of the spring 13. During restoration, the resistance between the audio input terminal 20 and the audio output terminal 30 is reduced, and the volume of the earphone is increased correspondingly. Because the volume of the earphone can be increased gradually, the user will not immediately have high volume audio blasting into their ears giving them time to adjust volume if needed.

Referring to FIGS. 3-6, a second embodiment of an earphone includes a C-shaped elastic bracket 100, and two earplugs 200 or headphones mounted to two ends of the bracket 100. The bracket 100 includes an elastic container 300 arranged on a center of the bracket 100 facing the two earplugs 200. The container 300 includes a rectangular mounting area 400. A rheostat 420 is fixed to an upper portion of the mounting area 400, and a spring 430 is arranged on a lower portion of the mounting area 400. The rheostat 420 is parallel to the spring 430. A first terminal A of the rheostat 420 is electrically connected to an audio output terminal 140 of the earphone. A slide terminal C is electrically connected to an audio input terminal 120 of the earphone. The slide terminal C is also fixed to the spring 430. When the spring 420 is at an original position (see FIG. 3), the slide terminal C of the rheostat 420 is at the first terminal A or close to the first terminal A of the rheostat 420. When the spring 430 is pressed to deform, the slide terminal C moves to a second terminal B of the rheostat 420. The container 300 further includes a long draw bar 450. A first terminal of the draw bar 450 is fixed to a side wall of the container 300, a second terminal of the draw bar 450 passes through the spring 430. The draw bar 450 includes a blocking portion 460 mounted on the second terminal of the draw bar 450, which can press the spring 430 to deform. When the elastic bracket 100 is pulled to deform, with the two ends of the bracket 100 moving away from each other, the draw bar 450 is moved, and the spring 430 is pressed by the blocking portion 460.

In use, a user pulls the elastic bracket 100 to a maximum open angle (see FIG. 4) firstly, and the spring 430 is deformed to shorten to a maximum amount. A resistance between the audio input terminal 120 and the audio output terminal 140 is at a largest value. Secondly, the user puts the opened elastic bracket 100 on their head, the open angle of the elastic bracket 100 will be decreased to a head angle (see FIGS. 5 and 6) depending on the size of the head of the user, and the head angle is between the maximum open angle (see FIG. 4) and the minimum open angle (see FIG. 3). When the elastic bracket 100 is placed on the head of the user, the blocking portion 460 returns a certain distance, the spring 430 returns to its original position (from FIG. 5 to FIG. 6), wherein the restoration of the spring 430 can be relatively gradual according to the choice of a coefficient of the spring 430. During restoration, the resistance between the audio input terminal 120 and the audio output terminal 140 is reduced gradually, and the volume of the earphone is increased gradually. Because the volume of the earphone is increased gradually, the user will not immediately listen to a high volume when he/she wears the earphone, which can protect the ear of the user from being hurt by a sudden high volume.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. An earphone comprising:

an audio input terminal and an audio output terminal;

an elastic member;

a rheostat comprising a first terminal, a second terminal, and a slide terminal; wherein the audio input terminal is electrically connected to the slide terminal of the rheostat, the audio output terminal is electrically connected to the first terminal of the rheostat, the slide terminal of the rheostat is fixed to the elastic member, wherein the slide terminal of the rheostat is at or near the first terminal of the rheostat in response to the elastic member being at an original position, the slide terminal moves to the second terminal of the rheostat in response to the elastic member being deformed; and an elastic bracket forming an elastic container and a draw bar, wherein the container comprises a mounting area, the rheostat and the elastic member are fixed in the mounting area, a first terminal of the draw bar is fixed to the container, a second terminal of the draw bar passes through the elastic member, to press the elastic member in response to the elastic bracket being pulled to deform.

2. The earphone of claim 1, further comprising a main body, wherein the rheostat is mounted in the main body, the main body forms a container to contain the elastic member, wherein a first terminal of the elastic member contacts a bottom of the container, a second terminal of the elastic member is connected to a button outside of the container, the elastic member is pressed to deform to shorten by pressing the button.

3. The earphone of claim 2, wherein the rheostat is parallel to the elastic member.

4. The earphone of claim 1, wherein the elastic bracket is C-shaped.

5. The earphone of claim 1, wherein the elastic member is a coil spring.

6. An earphone, comprising:

an audio input terminal and an audio output terminal;

an elastic member connected to the earphone in such a way that its state is changed via manipulation of the earphone;

a rheostat comprising a first terminal, and a slide terminal; wherein the audio input terminal is electrically connected to the slide terminal of the rheostat, the audio output terminal is electrically connected to the first terminal of the rheostat, the slide terminal of the rheostat is fixed to the elastic member; and wherein the resistance of the rheostat is adjusted by the movement of the slide terminal caused by the change of the state of the elastic member changed via the manipulation of the earphone to adjust a volume of the earphone; and an elastic bracket forming an elastic container and a draw bar, wherein the elastic container comprises a mounting area, the rheostat and the elastic member are fixed in the mounting area, a first terminal of the draw bar is fixed to the container, a second terminal of the draw bar passes through the elastic member, to press the elastic member in response to the elastic bracket being pulled to deform.

* * * * *